United States Patent [19]

Kuojarvi

[11] 4,014,057

[45] Mar. 29, 1977

[54] CHAIN-LIKE RESCUE DEVICES PARTICULARLY FOR SMALL BOATS

[76] Inventor: Kalervo Kuojärvi, Mikonkatu 25 B 29, 00100 Helsinki 10, Finland

[22] Filed: June 13, 1975

[21] Appl. No.: 586,629

[30] Foreign Application Priority Data

June 17, 1974 Finland ..... 741847

[52] U.S. Cl. ..... 9/14; 114/190; 182/70; 182/189; 182/190; 182/196; 272/109

[51] Int. Cl.[2] ..... B63C 9/26; B63C 9/22

[58] Field of Search ..... 9/14, 1 R, 1 C, 1.1, 9/1.6, 1.7; 182/70, 90, 92, 189, 190, 196; 272/60 A, 60 R, 61, 109; 114/190; 229/86

[56] References Cited

UNITED STATES PATENTS

| | | | |
|---|---|---|---|
| 1,484,070 | 2/1924 | Mast | 182/90 |
| 3,018,494 | 1/1962 | Guido | 9/14 |
| 3,216,030 | 11/1965 | Garfield | 182/196 |
| 3,754,291 | 8/1973 | Harris et al. | 9/14 |
| 3,754,758 | 8/1973 | Hanson | 182/189 |

FOREIGN PATENTS OR APPLICATIONS

| | | | |
|---|---|---|---|
| 311,103 | 5/1929 | United Kingdom | 182/190 |

*Primary Examiner*—Trygve M. Blix
*Assistant Examiner*—Charles E. Frankfort
*Attorney, Agent, or Firm*—Steinberg & Blake

[57] ABSTRACT

A rescue device particularly adapted for use with small boats. The device includes a plurality of bodies each formed with an aperture large enough to facilitate either manual grasping of the body or for receiving a foot of an individual to be rescued, the several bodies being interconnected in a given sequence by connecting units which form with the bodies a chain-like structure by means of which an individual can with his hands and feet climb upwardly along the structure back to a vessel.

8 Claims, 9 Drawing Figures

CHAIN-LIKE RESCUE DEVICES PARTICULARLY FOR SMALL BOATS

BACKGROUND OF THE INVENTION

The present invention relates to rescue devices for rescuing individuals who find themselves in a body of water adjacent a vessel such as a small boat or the like, either because the particular individual has fallen overboard or because the vessel has capsized, for example.

One of the great difficulties encountered in connection with marine rescue operations is encountered in connection with lifting out of the water a person who has hold of a rescue device. In general the opposed sides of the vessel, even where it is a small boat, are so high that an individual in the water cannot throw his leg over the side of the vessel. It is almost invariably necessary to drag the individual back into the boat. An operation of this latter type is exceedingly awkward owing to the additional weight of the particular individual being rescued, resulting from the fact that the clothing of the individual is wet and also owing to the fact that a rescuer must work very frequently in an extremely cramped space.

There are known prior art devices in the form of rescue lines or chains which are fixed to the vessel and which are capable of being thrown into the water from the vessel. In this connection reference may be made to U.S. Pat. Nos. 3,018,494 and 3,216,030 as well as to Swedish Pat. No. 92,771.

The particular rescue chain which is disclosed in U.S. Pat. No. 3,018,494 is used in such a way that the chain, fixed to the boat, at all times encircles the waist of an individual in the boat, so that should he fall from the boat and into the water, he cannot be carried too far away from the boat. The links of the particular rescue chain are preferably made large enough so that the particular individual can grasp the links and drag himself closer to the boat in order to facilitate his rescue.

In U.S. Pat. No. 3,216,030, there is disclosed a rescue line having a large number of circular gripping components attached thereto. A line of this type is fixed at its opposed ends to the boat and may be coiled to relatively small size around fastening rings in the boat, the arrangement being such that one end of such a line is easily detachable as, for example, when the boat capsizes, in which event the rescue line falls into the water. Then the person or persons who find themselves in the water throw the rescue line over the inverted boat and grip the rings which are attached to the line so that such individuals can climb up on to the capsized vessel.

SUMMARY OF THE INVENTION

It is a primary object of the present invention to provide a rescue device which will achieve substantial improvements in devices of this type. In particular, it is an object of the present invention to provide a rescue device with a chain-like structure which can very conveniently provide handholds and footholds for an individual to enable the individual to climb back on to a boat.

Also it is an object of the present invention to provide a rescue device which is relatively inexpensive.

Furthermore, it is an object of the present invention to provide a rescue device which can be rendered swiftly available to an individual who must be rescued.

Also it is an object of the present invention to provide a rescue device which does not have any risk of becoming undesirably tangled.

Furthermore, it is an object of the present invention to provide a rescue device which can be maintained in a relatively small package when it is not used and is instead ready for use.

According to the invention the rescue device includes a chain-like structure having consecutive, mutually connected, preferably crosswise disposed metal or plastic rings each having an aperture the size and shape of which is such that a person in the water can take hold with his hands of the rings while also being capable of using his legs in order to climb up into the craft by way of these rings. Thus, the rescue device of the invention can be used by an individual who is alone in a boat. In the event that such an individual falls from the boat he may reenter the boat with the aid of the rescue device of the invention. Such reentry to the boat will be carried out at the stern or bow. To reenter the boat in any other way is virtually impossible as a result of the heavy clothes which are drenched with water.

Thus, the rescue device of the invention is adapted to be used with vessels such as small boats and includes a plurality of bodies each formed with an aperture large enough to facilitate manual grasping of the bodies or to receive a foot of an individual to be rescued. A connecting means interconnects the plurality of bodies in a given sequence in such a way that the connecting means forms with the bodies a chain-like structure by means of which an individual in the water may with his hands grasp the bodies and with his legs climb upwardly along the bodies back into the vessel.

BRIEF DESCRIPTION OF THE DRAWINGS

The invention is illustrated by way of example in the accompanying drawings which form part of this application and in which.

DESCRIPTION OF PREFERRED EMBODIMENTS

Figure 1:
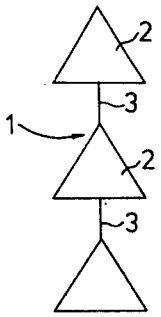
FIG. 1 is a schematic elevation of at least part of one possible embodiment of a chain-like structure of the invention to be used in the rescue device, the structure being shown in FIG. 1 in a vertically hanging attitude.
Figure 2:
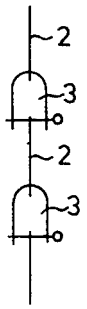
FIG. 2 is a schematic side view of the structure of FIG. 1.

Referring first to FIGS. 1 and 2, the rescue device of the invention includes a chain-like structure part of which is illustrated in FIGS. 1 and 2. This chain-like structure of the rescue device of the invention is particularly adapted for use with a vessel such as a small boat. The chain-like structure 1 includes a plurality of bodies 2, three of which are illustrated in FIG. 1, although it is to be understood that a considerably larger number are utilized in the actual device. The several bodies 2 are each formed with an aperture large enough to facilitate grasping of the bodies 2 manually by an individual as well as to be large enough to receive a foot of the individual. The bodies 2 are arranged in the sequence shown in FIG. 1, one above the other when the chain-like structure 1 hangs vertically, and each body 2 in the example illustrated is of a substantially triangular configuration and may be made of metal or a relatively strong plastic. Thus, each body 2 is in the form of a ring of triangular configuration.

Figure 7:
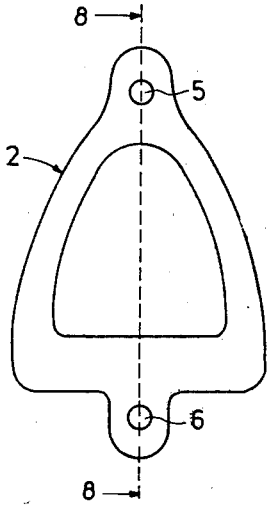
FIG. 7 shows in elevation the actual construction of triangular bodies utilized in the embodiment of FIGS. 1 and 2 as well as in the embodiment of FIGS. 5 and 6.

The several bodies 2 are connected in a given sequence one to the next by way of a connecting means 3. As may be seen from FIG. 2, the connecting means 3 includes a plurality of units each of which has a substantially U-shaped member having a pair of free legs terminating respectively in free end regions, and each unit of the connecting means 3 has a straight rod extending across the free legs of the U-shaped rod at the free end regions thereof and fixed to the legs of the U-shaped rod at the free end regions thereof. For example, each U-shaped rod may terminate at the ends of its legs in a pair of eyes through which the straight rod passes, and this straight rod may take the form of a simple bolt having at one end a head engaging one of the legs and carrying at its other end a nut engaging the other of the legs of the U-shaped rod of each unit of the connecting means 3. The triangular rings 2 have, when the chain-like structure hangs vertically as shown in FIG. 1, upper and lower ends respectively formed with openings passing therethrough. Thus, referring to FIG. 7, the actual construction of one of the triangular rings 2 is illustrated. Thus it will be seen that the body 2 of FIG. 7 is in the form of a relatively flat sheet member made of any suitable metal or plastic and having the illustrated upper and lower regions respectively formed with the openings 5 and 6. In the arrangement shown in FIGS. 1 and 2, the U-shaped rods of each unit of the connecting means 3 extends through the lower opening 6 while the straight rod of each unit of the connecting means 3 extends through the upper opening 5, so that in this way the several bodies 2 are interconnected one with the next to form the chain-like structure illustrated. It will be noted that in this arrangement the units 3 are respectively situated in a plane perpendicular to the plane occupied by the bodies 2, and this structure can very conveniently be grasped manually by an individual with the aperture of each body 2 being large enough also to receive a foot of the individual. It will be noted from FIG. 7 that the aperture has a straight horizontal lower region facilitating receiving of a foot of an individual.

Figure 8:
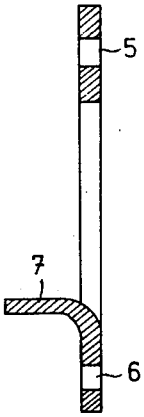
FIG. 8 is a sectional elevation of the structure of FIG. 7 taken along line 8—8 of FIG. 7 in the direction of the arrows.

As is illustrated in FIG. 8, at the lower region of the aperture of each body 2, the latter has fixed thereto as being formed integrally therewith, a horizontally extending projection 7 affording an extremely convenient foothold for an individual utilizing the rescue device of the invention.

The chain-like structure part of which is shown in FIGS. 1 and 2 in a schematic manner can be attached at one end, for example, by a hook or a suitable rope, to the vessel so that when required the structure 1 can be quickly thrown overboard into the water to be available to an individual who is to be rescued. However, in connection with FIG. 9 referred to below, the device of the invention includes further features rendering the device extremely convenient to be used by an individual who must be rescued.

Figure 3:
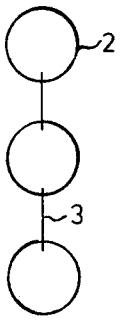
FIG. 3 is a front elevation showing part of another embodiment of a chain-like structure of a rescue device of the invention, the structure of FIG. 3 also being shown in a vertically hanging attitude.

In the embodiment of the invention which is illustrated in FIG. 3, the structure is substantially the same as that of FIGS. 1 and 2 except that the bodies 2 are of a circular configuration. These circular bodies 2 thus will have circular apertures large enough to receive a foot while at the same time enabling the bodies 2 to be conveniently grasped manually. The upper and lower end regions of each body 2 is formed with openings such as the openings 5 and 6 shown in FIG. 7, and the connecting means 3 interconnects the circular bodies to a FIG. 3 in the same way as the connecting means 3 of FIGS. 1 and 2.

Figure 4:
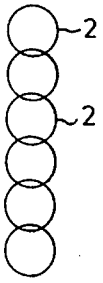
FIG. 4 is a schematic illustration of yet another possible embodiment of part of a chain-like structure of the invention also shown in FIG. 4 in a vertical, freely hanging attitude.

According to the embodiment of the invention shown in FIG. 4, the bodies 2 may also be in the form of circular rings identical with those of FIG. 3. However, in this case the lower end of one body 2 overlaps the upper end of the next body 2, the arrangement being such that the opening 6 of one body is in register with the opening 5 of the next lower body, and these aligned openings 5 and 6 will receive suitable fastening pins or the like enabling several rings to be directly connected pivotally one to the next to form a chain-like structure as shown in FIG. 4. Thus, the embodiment of FIG. 4 has a connecting means formed by portions of the bodies to themselves, these portions overlapping each other to form the connecting means of FIG. 4.

Of course, with the embodiments of FIGS. 3 and 4 the circular bodies can be made of a suitable metal or plastic.

Figure 5:
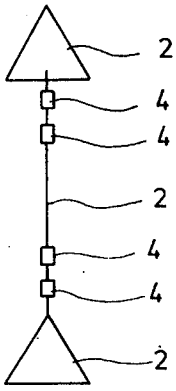
FIG. 5 is a schematic front elevation of part of a further embodiment of a chain-like structure of a rescue device according to the invention also shown in FIG. 5 in a freely hanging vertical attitude.
Figure 6:
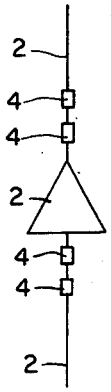
FIG. 6 is a schematic side view of the structure of FIG. 5.

FIGS. 5 and 6 illustrate a particularly advantageous embodiment of the invention. In the embodiment of FIGS. 5 and 6 the chain-like structure also includes triangular bodies 2 as shown in FIGS. 7 and 8 and described above.

However, in the embodiment of FIGS. 5 and 6, the connecting means 4 includes between each pair of consecutive bodies 2 an even number of units which may be identical with the units of the connecting means 3 described above in connection with FIGS. 1 and 2. Thus, between each pair of consecutive bodies 2 the connecting unit connected to the lower end of the upper body will have a U-shaped rod of the next connecting unit extending around its straight rod, and so on, four such connecting units being shown between each pair of consecutive bodies 2 in FIGS. 5 and 6, although if desired only two such connecting units may be utilized between each pair of consecutive bodies 2. It will be noted that FIG. 6 is oriented with respect to FIG. 5 in such a way that the bodies 2 of FIG. 6 are somewhat lower than the bodies 2 of FIG. 5 with, for example, the uppermost reference character 4 designating in FIG. 6 the connecting unit which is connected directly to the uppermost body 2 of FIG. 6 while the same reference character 4 is used in FIG. 5 to designate the second connecting unit from the top of FIG. 5. By utilizing an even number of such connecting units between each pair of consecutive bodies 2, the successive connecting units will be respectively located in mutually perpendicular planes with the use of an even number of such units resulting in the fact that the successive bodies 2 are also located in mutually perpendicular planes as illustrated. Of course, the arrangement may be such that the successive bodies 2 are connected one to the next in such a way that when the chain-like structure hangs vertically as shown in FIGS. 5 and 6 the successive bodies 2 are respectively arranged in planes which make with respect to each other an angle different from a right angle, although the planes should be substantially transverse with each other to provide a crosswise positioning of the successive rings 2 in the chain structure.

This particular arrangement is of advantage in that when the chain-like structure 1 hangs down in engagement with an exterior side surface of the vessel, flush against such a side surface, for example, it is still relatively easy for a person in the water to grasp one or more of the rings 2 and it is also much easier for the individual to utilize his legs in climbing up the series of the rings 2, so that in this way the ascent back into the craft is relatively easy to perform and can be quickly carried out. Thus, with this arrangement even if some of the rings 2 should be flush against the exterior surface of the vessel, other rings 2 will project substantially perpendicularly from the surface of the vessel so as to be easy to grasp.

Figure 9:
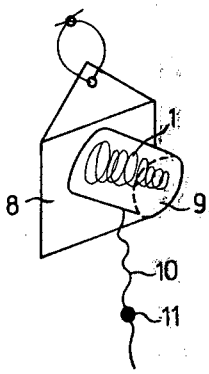
FIG. 9 is a schematic illustration of the chain-like structure of the rescue device of the invention housed within an enclosure which is illustrated in FIG. 9 together with the remaining components of an embodiment of a rescue device according to the invention.

FIG. 9 shows a preferred embodiment of the entire rescue device of the invention. The device of FIG. 9 includes a mounting means 8 for mounting an enclosure 9 on the vessel. The mounting means 8 may take the form, for example, of a relatively strong sheet of metal having at its upper substantially pointed end region an opening through which extends a rope, as illustrated, this rope in turn being fixed to a pin above the plate 8 as shown schematically in FIG. 9, and this pin is fixed directly to a part of the vessel. For example, the pin may take the form of a bolt directly fixed to part of the hull of the vessel and having at one end an eye through which the rope shown at the upper part of FIG. 9 passes, this rope being tied into a suitable knot, for example, and also passing through the opening at the upper part of the plate 8 as described above.

The enclosure 9 is made of a sheet material such as a plastic foil which can be easily ruptured. The inner wall of the enclosure 9 is fixed in any suitable way to the plate 8 as, for example, by being glued thereto. The chain-like structure 1 is housed within the enclosure 9. However, that one of the bodies 2 of the chain-like structure 1 of FIG. 9 which forms the uppermost body of this chain-like structure when it hangs freely is fixed directly to the plate 8. For example, this particular body 2 will have a suitable fastening pin such as a bolt and nut or the like extend through its upper opening 5 and through the sheet material of the enclosure 9 as well as through a suitable opening in the plate 8, so that in this way the uppermost body 2 of the freely hanging chain-like structure is reliably fixed with the plate 8.

The enclosure 9 may have, for example, a conventional tear strip by means of which the enclosure 9 can be ruptured so as to release the chain-like structure. Extending from this tear strip is a flexible ribbon 10 having a fluorescent coating as its exterior so that the ribbon 10 is readily visible. The length of the ribbon 10 is such that the ribbon 10 can hang from the enclosure 9 down to the surface of the water when the mounting means 8 mounts the enclosure 9 on a vessel in the manner shown schematically in FIG. 9. Thus, the plate 8 may be situated at the exterior of the vessel against the stern thereof. In addition, the part of the ribbon 10 which otherwise might sink into the water carries a float 11 which enables this part of the ribbon 10 to float on the surface of the water.

Thus, with this construction should an individual fall overboard, or if the vessel should happen to capsize, an individual in the water can readily grasp and pull on the ribbon 10 so as to rupture the enclosure 9 thus releasing the chain-like structure 1 which immediately falls to assume its freely hanging attitude suspended from the plate 8, and of course the length of the chain-like structure is sufficiently great so that when it hangs freely the bottom end of the chain-like structure is accessible at the surface of the water to an individual who can then readily climb up the chain-like structure back on to the boat.

Although a few particularly desirable embodiments of the rescue device of the invention have been described above and shown in the drawings, it is clear that a person skilled in the art can provide various modifications within the scope of the claims which follow.

What is claimed is:

1. In a rescue device for a vessel such as a small boat, a plurality of bodies each formed with an aperture large enough to facilitate manual grasping of the bodies by an individual to be rescued or to receive a foot of the individual to be rescued, and connecting means connecting said bodies in a given sequential arrangement one to the next and forming with said bodies a chain-like structure by means of which an individual can with his hands and feet climb upwardly along the structure back to the vessel, each body having opposed upper and lower end regions when the chain-like structure hangs freely, and each of said end regions of each body being formed with openings passing therethrough, respectively, and said connecting means including a plurality of units each including a rod of substantially U-shaped configuration having a pair of opposed legs terminating in a pair of free end regions, respectively, and a substantially straight rod extending across said legs at said free end regions thereof and connected thereto, and the U-shaped rod of one of said units of said connecting means extending through one of said openings of each body while the substantially straight rod of one of said units extends through the other of said openings of each body.

2. The combination of claim 1 and wherein each body is made of a self-sustaining material, such as metal or plastic, and has a portion surrounding said aperture thereof and situated in a vertical plane when the chain-like structure hangs freely, and each body having at a lower region of its aperture a substantially rigid projection fixed to said body and projecting substantially horizontally therefrom beyond the remainder of said body when the chain-like structure hangs freely, so that each projection forms a convenient foothold for the body.

3. The combination of claim 1 and wherein each body is in the form of a ring of triangular configuration.

4. The combination of claim 1 and wherein in each body is of a circular configuration.

5. The combination of claim 1 and wherein the aperture of each body has a straight horizontal lower region, when the chain-like structure hangs freely, for facilitating receiving of a foot of an individual.

6. In a rescue device for a vessel such as a small boat, a plurality of bodies each formed with an aperture large enough to facilitate manual grasping of the bodies by an individual to be rescued or to receive a foot of the individual to be rescued, and connecting means connecting said bodies in a given sequential arrangement one to the next and forming with said bodies a chain-like structure by means of which an individual can with his hands and feet climb upwardly along the structure back to the vessel an enclosure made of a sheet material which can be ruptured enclosing said chain-like structure with the latter gathered together into a relatively small size within said enclosure, mounting means operatively connected with said enclosure for mounting the latter on the vessel, and an elongated flexible ribbon fixed to and extending from said enclosure to hang therefrom down to an elevation where said ribbon can readily be grasped by an individual in the water, and said ribbon being connected with said enclosure for rupturing the same when the ribbon is pulled so that upon rupture of the enclosure the chain-like structure will fall therefrom to be accessible to an individual in the water.

7. The combination of claim 6 and wherein said ribbon has a fluorescent color rendering it readily visible.

8. The combination of claim 6 and wherein said ribbon is long enough to trail on the surface of the water and carries distant from the enclosure a float for floating on the surface of the water.

* * * * *